US010010799B2

(12) United States Patent
Williford-Young

(10) Patent No.: US 10,010,799 B2
(45) Date of Patent: Jul. 3, 2018

(54) TUNNEL ASSEMBLY

(71) Applicant: Angela Williford-Young, Sumner, GA (US)

(72) Inventor: Angela Williford-Young, Sumner, GA (US)

( * ) Notice: Subject to any disclaimer, the term of this patent is extended or adjusted under 35 U.S.C. 154(b) by 0 days.

(21) Appl. No.: 15/232,966

(22) Filed: Aug. 10, 2016

(65) Prior Publication Data

US 2018/0043271 A1 Feb. 15, 2018

(51) Int. Cl.
*A63G 21/18* (2006.01)
*A63G 31/00* (2006.01)

(52) U.S. Cl.
CPC ..... *A63G 31/007* (2013.01)

(58) Field of Classification Search
CPC ..... A63G 9/00; A63G 312/00; A63G 31/16; A63G 31/007; A63B 9/00; A63H 33/00; A63H 33/3061
USPC ..... 472/117, 128, 13; 482/35–37; 239/207, 239/279, 543
See application file for complete search history.

(56) References Cited

U.S. PATENT DOCUMENTS

| | | | | |
|---|---|---|---|---|
| 2,982,547 | A | 5/1961 | Carrier | |
| 3,539,181 | A * | 11/1970 | Larsen | A63G 9/00 239/207 |
| 4,749,130 | A * | 6/1988 | Utzinger | B01D 11/0449 239/543 |
| 5,482,510 | A * | 1/1996 | Ishii | A63G 31/16 472/61 |
| 5,669,822 | A | 9/1997 | Smollar et al. | |
| 6,050,872 | A * | 4/2000 | Cahill | A63H 33/3061 239/279 |
| 6,210,247 | B1 * | 4/2001 | Rodriguez Ferre | A63B 9/00 446/476 |
| D625,891 | S | 10/2010 | Krotts et al. | |
| 7,967,692 | B2 | 6/2011 | Werner | |
| 8,951,133 | B2 | 2/2015 | Leach | |
| 2008/0009357 | A1 | 1/2008 | Fitzgerald | |
| 2010/0137068 | A1 | 6/2010 | Bogar et al. | |

FOREIGN PATENT DOCUMENTS

WO WO2004071609 8/2004

* cited by examiner

*Primary Examiner* — Kien Nguyen

(57) ABSTRACT

A tunnel assembly includes a tube that may be placed on a support surface thereby facilitating a user to run through the tube. The tube has an inside diameter of at least one hundred twenty cm. A figure head is coupled to the tube to enhance an ornamental appearance of the tube. A spray unit is coupled to the tube. The spray unit is fluidly coupled to a fluid source thereby facilitating the spray unit to spray a fluid into an interior of the tube.

8 Claims, 4 Drawing Sheets

TUNNEL ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to tunnel devices and more particularly pertains to a new tunnel device for recreational water play.

BRIEF SUMMARY OF THE INVENTION

An embodiment of the disclosure meets the needs presented above by generally comprising a tube that may be placed on a support surface thereby facilitating a user to run through the tube. The tube has an inside diameter of at least one hundred twenty cm. A figure head is coupled to the tube to enhance an ornamental appearance of the tube. A spray unit is coupled to the tube. The spray unit is fluidly coupled to a fluid source thereby facilitating the spray unit to spray a fluid into an interior of the tube.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
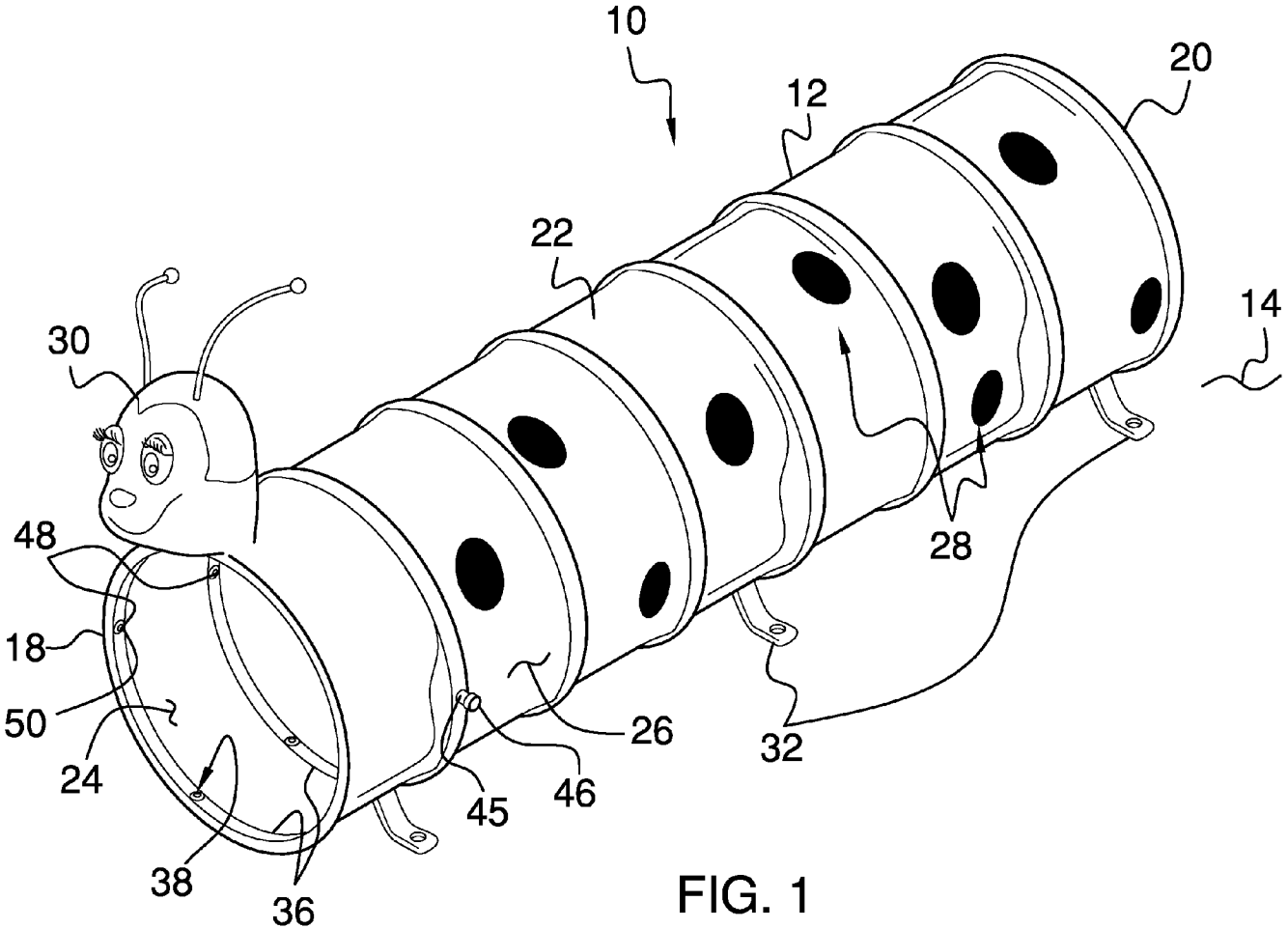
FIG. 1 is a perspective view of a tunnel assembly according to an embodiment of the disclosure.
Figure 2:
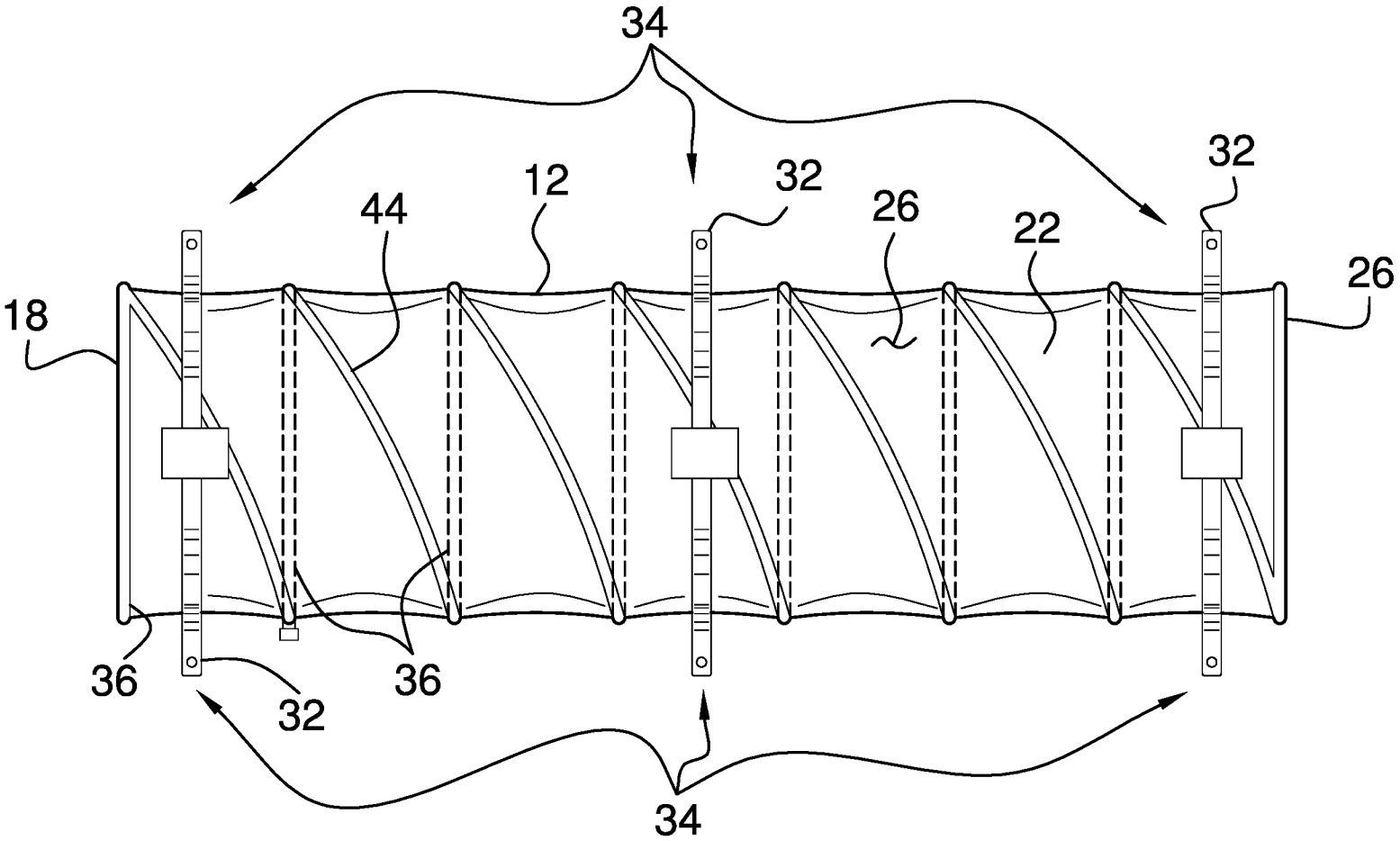
FIG. 2 is a bottom phantom view of an embodiment of the disclosure.
Figure 4:
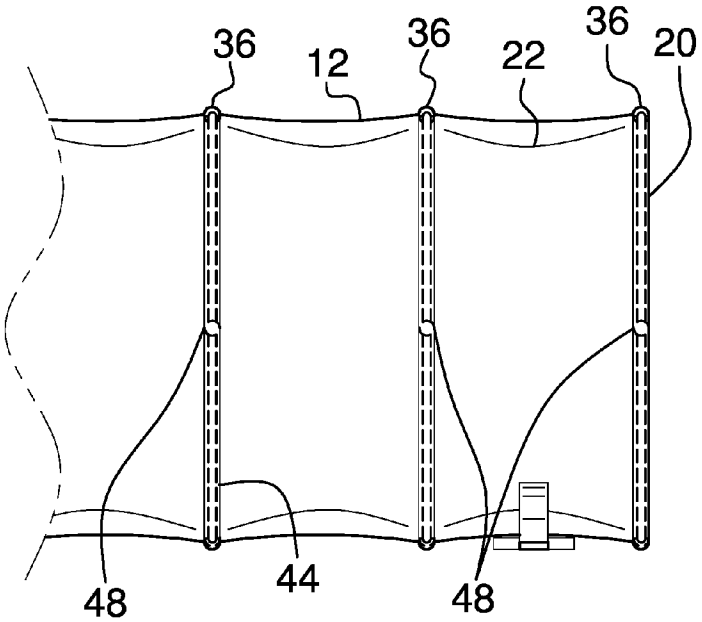
FIG. 4 is a right side phantom view of an embodiment of the disclosure.
Figure 3:
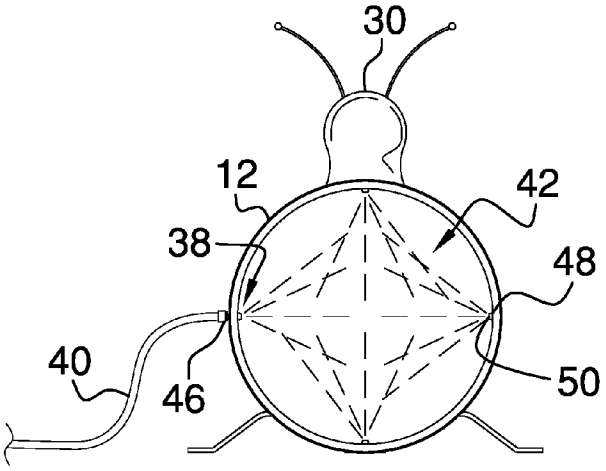
FIG. 3 is a back view of an embodiment of the disclosure.
Figure 5:
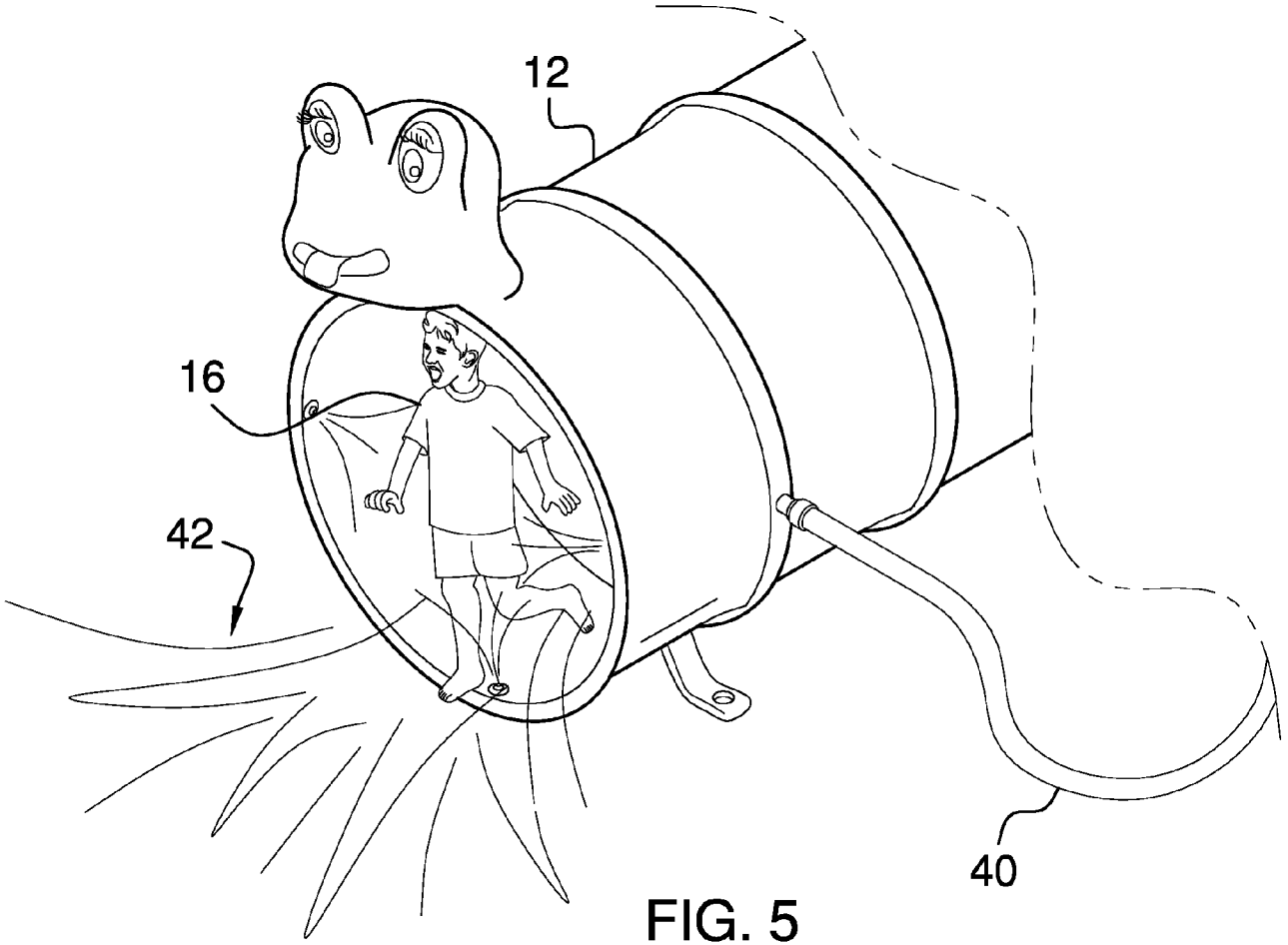
FIG. 5 is a perspective in-use view of an embodiment of the disclosure.

With reference now to the drawings, and in particular to FIGS. 1 through 5 thereof, a new tunnel device embodying the principles and concepts of an embodiment of the disclosure and generally designated by the reference numeral 10 will be described.

As best illustrated in FIGS. 1 through 5, the tunnel assembly 10 generally comprises a tube 12 that may be placed on a support surface 14. Thus, a user 16 may run through the tube 12. The tube 12 has an inside diameter of at least one hundred twenty cm. The tube 12 has a first end 18, a second end 20 and an outer wall 22 extending therebetween. Each of the first end 18 and the second end 20 are open.

The outer wall 22 has an inner surface 24 and an outer surface 26. The outer surface 26 has indicia 28 printed thereon. The indicia 28 may comprise spots resembling markings on a lady bug or the like. The tube 12 is comprised of a flexible material. Moreover, the tube 12 is comprised of a fluid 42 permeable material such as mesh or the like.

A figure head 30 is provided. The figure head 30 is coupled to the tube 12. Thus, the figure head 30 enhances an ornamental appearance of the tube 12. The figure head 30 is positioned on the outer surface 26 and the figure head 30 may be aligned with the first end 18. The figure head 30 may be structured to resemble a lady bug head or the like.

A plurality of feet 32 is provided. Each of the feet 32 is coupled to the outer surface 26 of the tube 12. The feet 32 are spaced apart from each other and are distributed between the first end 18 and the second end 20. The plurality of feet 32 is arranged in a plurality of opposing sets 34. Each of the opposing sets 34 of feet 32 extends outwardly from opposite sides of the tube 12. Each of the feet 32 abuts the support surface 14 thereby facilitating the tube 12 to be motionless on the support surface 14. The support surface 14 may be ground.

A plurality of rings 36 is provided. Each of the rings 36 is coupled to the inner surface 24 of the tube 12. The rings 36 are spaced apart from each other and are distributed between the first end 18 and the second end 20. Each of the rings 36 is comprised of a rigid material. Thus, each of the rings 36 retains the tube 12 in a cylindrical shape. Each of the rings 36 is substantially hollow.

A spray unit 38 is provided. The spray unit 38 is coupled to the tube 12. The spray unit 38 may be fluidly coupled to a fluid source 40. Thus, the spray unit 38 sprays the fluid 42 into an interior of the tube 12.

The spray unit 38 comprises a conduit 44 that is coupled to the tube 12. The conduit 44 extends through each of the rings 36. The conduit 44 extends between each of the rings 36. Moreover, the conduit 44 forms a coil extending between the first end 18 and the second end 20 of the tube 12. The conduit 44 has a first end 45 and the first end 45 of the conduit 44 extends outwardly from the outer surface 26 of the tube 12.

A coupler 46 is coupled to the first end 45 of the conduit 44. The coupler 46 may be fluidly coupled to the fluid source 40. The fluid source 40 may be a water hose or the like. The fluid 42 may be water. The coupler 46 may be a hose coupler or the like.

A plurality of spray nozzles 48 is provided. Each of the spray nozzles 48 is coupled to an associated one of the rings 36. The spray nozzles 48 are spaced apart from each other and are distributed around the associated ring 36. Each of the spray nozzles 48 has a distal end 50 with respect to the associated ring. The distal end 50 of each of the spray nozzles 48 is open.

Each of the spray nozzles 48 is fluidly coupled to the conduit 44. Thus, each of the spray nozzles 48 sprays the fluid 42 into the interior of the tube 12. The user 16 is sprayed with the fluid 42 when the user 16 runs through the tube 12. Each of the spray nozzles 48 may comprise a low pressure fluid nozzle or the like.

In use, the tube 12 is stretched out and the tube 12 is positioned on the support surface 14 such that each of the feet 32 abuts the support surface 14. The fluid source 40 is fluidly coupled to the coupler 46. Thus, the fluid 42 is sprayed outwardly from each of the spray nozzles 48. The user 16 runs through the tube 12 and the user 16 is sprayed with the fluid 42. The fluid 42 drains through the tube 12. The fluid source 40 is uncoupled from the coupler 46 and the tube 12 is compressed for storage.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tunnel assembly being configured to spray a fluid on a user, said assembly comprising:

a tube being configured to be placed on a support surface thereby facilitating a user to run through said tube, said tube having an inside diameter of at least one hundred twenty cm, said tube having a first end, a second end and an outer wall extending therebetween, each of said first end and said second end being open, said outer wall having an inner surface and an outer surface;

a figure head being coupled to said tube wherein said figure head is configured to enhance an ornamental appearance of said tube; and a spray unit being coupled to said tube, said spray unit being configured to be fluidly coupled to a fluid source thereby facilitating said spray unit to spray a fluid into an interior of said tube, said spray unit comprises a conduit being coupled to said tube, said conduit forming a coil extending from the first end to the second end of said tube, said conduit including a plurality of spray nozzles, each of said spray nozzles being inwardly directed from said inner surface of said outer wall, said spray nozzles being spaced around a circumference of said inner surface of said outer wall.

2. The assembly according to claim 1, wherein said outer surface has indicia being printed thereon.

3. The assembly according to claim 1, further comprising a plurality of rings, each of said rings being coupled to said inner surface of said tube, said rings being spaced apart from each other and being distributed between said first end and said second end, each of said rings being comprised of a rigid material such that each of said rings retains said tube in a cylindrical shape, each of said rings being substantially hollow.

4. The assembly according to claim 3, further comprising a coupler being coupled to said first end of said conduit, said coupler being configured to be fluidly coupled to said fluid source.

5. The assembly according to claim 1, wherein:

said tube includes a plurality of rings; and said conduit extending through each of said rings, said conduit extending between each of said rings such that said conduit forms said coil extending between said first end and said second end of said tube, said conduit having a first end, said first end of said conduit extending outwardly from said outer surface of said tube.

6. The assembly according to claim 5, wherein each of said spray nozzles being coupled to an associated one of said rings, said spray nozzles being spaced apart from each other and distributed around said associated ring, each of said spray nozzles having a distal end with respect to said associated ring, said distal end of each of said spray nozzles being open.

7. The assembly according to claim 6, wherein each of said spray nozzles is fluidly coupled to said conduit wherein each of said spray nozzles is configured to spray the fluid into said interior of said tube thereby facilitating the user to be sprayed with the fluid when the user runs through said tube.

8. A tunnel assembly being configured to spray a fluid on a user, said assembly comprising:

a tube being configured to be placed on a support surface thereby facilitating a user to run through said tube, said tube having an inside diameter of at least one hundred twenty cm, said tube having a first end, a second end and an outer wall extending therebetween, each of said first end and said second end being open, said outer wall having an inner surface and an outer surface, said outer surface having indicia being printed thereon;

a figure head being coupled to said tube wherein said figure head is configured to enhance an ornamental appearance of said tube, said figure head being positioned on said outer surface;

a plurality of rings, each of said rings being coupled to said inner surface of said tube, said rings being spaced apart from each other and being distributed between said first end and said second end, each of said rings being comprised of a rigid material such that each of said rings retains said tube in a cylindrical shape, each of said rings being substantially hollow; and a spray unit being coupled to said tube, said spray unit being configured to be fluidly coupled to a fluid source thereby facilitating said spray unit to spray a fluid into an interior of said tube, said spray unit comprising:

a conduit being coupled to said tube, said conduit extending through each of said rings, said conduit extending between each of said rings such that said conduit forms a coil extending between said first end and said second end of said tube, said conduit having a first end, said first end of said conduit extending outwardly from said outer surface of said tube, a coupler being coupled to said first end of said conduit, said coupler being configured to be fluidly coupled to said fluid source, and a plurality of spray nozzles, each of said spray nozzles being inwardly directed from said inner surface of said outer wall, said spray nozzles being spaced around a circumference of said inner surface of said outer wall, each of said spray nozzles being coupled to an associated one of said rings, said spray nozzles being spaced apart from each other and distributed around said associated ring, each of said spray nozzles having a distal end with respect to said associated ring, said distal end of each of said spray nozzles being open, each of said spray nozzles being fluidly coupled to said conduit wherein each of said spray nozzles is configured to spray the fluid into said interior of said tube thereby facilitating the user to be sprayed with the fluid when the user runs through said tube.

* * * * *